United States Patent [19]

Wisotsky et al.

[11] Patent Number: 4,686,054

[45] Date of Patent: Aug. 11, 1987

[54] SUCCINIMIDE LUBRICATING OIL DISPERSANT

[75] Inventors: Max J. Wisotsky, Highland Park; Ricardo Bloch; Darrell W. Brownawell, both of Scotch Plains; Frank J. Chen, Piscataway; Antonio Gutierrez, Mercerville, all of N.J.

[73] Assignee: Exxon Research & Engineering Co., Florham Park, N.J.

[21] Appl. No.: 878,033

[22] Filed: Jun. 24, 1986

Related U.S. Application Data

[63] Continuation-in-part of Ser. No. 645,828, Aug. 31, 1984, which is a continuation of Ser. No. 543,269, Oct. 19, 1983, abandoned, which is a continuation of Ser. No. 293,146, Aug. 17, 1981, abandoned.

[51] Int. Cl.[4] ..... C10M 137/06; C10M 133/44

[52] U.S. Cl. ..... 252/32.7 E; 252/33.4; 252/51.5 A; 252/46.4

[58] Field of Search ..... 252/51.5 A, 32.7 E, 252/33.4

[56] References Cited

U.S. PATENT DOCUMENTS

| | | | |
|---|---|---|---|
| 3,401,118 | 9/1968 | Benoit, Jr. | 252/51.5 A |
| 3,415,750 | 12/1968 | Anzenberger | 252/51.5 A |
| 3,455,827 | 7/1969 | Mehmedbasich | 252/51.5 A X |
| 3,630,902 | 12/1971 | Coupland | 252/51.5 A |

FOREIGN PATENT DOCUMENTS

| | | |
|---|---|---|
| 1018982 | 2/1966 | United Kingdom . |
| 1162436 | 8/1969 | United Kingdom . |

OTHER PUBLICATIONS

Smalheer, Cili et al.; "Lubricant Additives", pp. 2–4 and 10; 1967.

*Primary Examiner*—Jacqueline V. Howard
*Attorney, Agent, or Firm*—J. J. Mahon; R. A. Maggio; J. B. Murray, Jr.

[57] ABSTRACT

There is a disclosed an improved lubricating oil dispersant suitable for both gasoline engine and diesel engine lubricating oil, the dispersant being prepared in a sequential process whereby a polyolefin succinic anhydride is reacted first with an alkylene polyamine and subsequently with maleic anhydride of a $C_1$–$C_{18}$ alkenyl or alkyl succinic anhydride to provide a diimide dispersant having a final mole ratio of 2.3 to 3.0 moles of anhydride per mole of polyamine.

12 Claims, No Drawings

SUCCINIMIDE LUBRICATING OIL DISPERSANT

Continuation-in-Part application of U.S. Ser. No. 645,828, filed Aug. 31, 1984, which was a Continuation of U.S. Ser. No. 543,269, filed Oct. 19, 1983, now abandoned, which was a Continuation of U.S. Ser. No. 293,146, filed Aug. 17, 1981 which was abandoned Oct. 25, 1983.

This invention relates to lubricating oil dispersants which exhibit highly effective dispersant potency in both gasoline and diesel engines. More particularly, the invention relates to lubricating oil compositions for use both in gasoline and diesel engine formulations which meet current performance requirements for both types of engines, the formulations being characterized as containing novel dispersants prepared in a particular reaction sequence.

A current objective in the industry is to provide lubricating oil compositions which meet or exceed engine qualification standards of dispersancy for both gasoline and diesel or compression ignition engines. Heretofore, dispersants have been developed which meet one or the other of these requirements, but development of a dispersant which satisfies the highest service classification requirements of the relevant engine qualification tests for both types of oil has not been entirely successful. It is an object of the present invention to provide lubricating oil compositions containing novel dispersants which meet these goals.

The present invention is within the broad field of improved polyolefin. Particularly polyisobutenyl succinic acid or anhydride-polyamine reaction product dispersants, and such dispersants are disclosed generally, for example, in U.S. Pat. No. 3,172,892 issued Mar. 9, 1965 to LeSuer et al.

U.S. Pat. No. 3,216,936 issued Nov. 9, 1975 to LeSuer et al. shows lubricating oil additives prepared by acylation of an alkylene amine with both a polyolefin succinic anhydride and an aliphatic monocarboxylic acid, preferably a mono acid having more than 12 carbon atoms such as stearic or oleic acid. The products can be prepared by reacting both acidic compounds simultaneously with a polyamine or by first reacting the polyolefin succinic acid with polyamine and subsequently with monocarboxylic acid. The products so formed are said to be particularly useful in improving the thermal stability of lubricating compositions which contain metal phosphorodithioates.

British Pat. No. 1,018,982 (1966) discloses lubricating oil additives which are the reaction products of three components: alkenyl succinic anhydrides, polyamines and carboxylic acids and the products are said to have improved sludge dispersant properties. The alkenyl succinic anhydrides are those similar to the materials of the present invention, i.e.. preferably polyisobutenyl succinic anhydrides and the polyamines are also similar, i.e., the alkylene polyamines. The carboxylic acids of this reference are disclosed as being mono- or di- carboxylic acids having 1 to 30, preferably 1 to 18 carbon atoms, with acetic acid being preferred since it forms an imidazoline or pyrimidine with a minimum of carbon atoms. This reference also states that lower molecular weight carboxylic acids are more effective in promoting the sludge dispersing activity of the final product. The preparative method disclosed in British Pat. No. 1,019,982 comprises either first reacting the carboxylic acid and the polyamine in what is described as an imidazoline or pyrimidine forming reaction with subsequent reaction with alkenyl succinic anhydride or by reacting the three materials simultaneously.

U.S. Pat. No. 3,415,470 issued Dec. 10. 1968 to Anzenberger et al discloses lubricant additives categorized as imidazolines which are prepared by reacting a polyethylene polyamine with a mono-carboxylic acid or a di-carboxylic acid to form a heterocyclic imidazoline intermediate which is subsequently reacted with a polyalkenyl succinic anhydride to provide a bis-imidazoline which is said to have improved detergency and dispersancy in lubricating oil formulations.

U.S. Pat. No. 3,374.174 issued Mar. 19, 1968 to LeSuer discloses lubricant additives prepared by reacting amines. Including alkylene polyamines, with both a high molecular weight alpha-beta unsaturated monocarboxylic acid and a dicarboxylic acid or anhydride, preferably those having up to 12 carbon atoms. The patent discloses the simultaneous reaction of all three materials or a sequential process whereby there is first formed an acylated amine intermediate with the amine and high molecular weight carboxylic acid which is subsequently reacted with the di-carboxylic acid reactant.

It is known in the dispersant field as disclosed, for example, in U.S. Pat. No. 4,173,540 issued Nov. 6, 1979 to Lonstrup et al to react polyisobutenyl succinic anhydride and polyamines in a molar ratio of 2.0 to 2.5 moles of anhydride per mole of polyamine to provide a diimide dispersant, however, such products will not meet the objectives achieved in accordance with the present invention, with regard to qualification for both gasoline and diesel engine formulations.

The present invention is considered distinguished from the foregoing references in that this invention requires a particular reaction sequence characterized by the use of a dicarboxylic acid anhydride compound in the final step and an overall mole ratio of anhydride to polyamine within a relatively narrow and critically defined range. These parameters have been found essential to provide lubricating oil compositions which give demonstrated performance values in engine tests required to qualify for the highest grade service classifications for both gasoline and diesel engine lubricating oil composition. The reaction sequence is particularly critical and most notably with regard to the prior art references noted above, products prepared in a simultaneous reaction technique are not suitable and will not meet the objectives of this invention.

In accordance with this invention, there are provided lubricating oil compositions exhibiting improved dispersancy in both gasoline and diesel engines comprising a major amount of lubricating oil and an effective amount of a polyalkenyl succinimide dispersant, said dispersant being prepared in a two-step sequential process comprising (a) first reacting a polyalkenyl succinic anhydride, the polyalkenyl being a polymer of a $C_3$ or $C_4$ olefin and an alkylene polyamine of the formula $H_2N(CH_2)_n(NH(CH_2)_n)_mNH_2$, wherein n is 2 or 3 and m is 0 to 10 in a molar ratio of about 1.0 to 2.2 moles of succinic anhydride per mole of polyamine, and (b) reacting the product step of (a) with a di-carboxylic acid anhydride selected from the group consisting of maleic anhydride, succinic anhydride and $C_1$–$C_{18}$, preferably $C_8$–$C_{18}$ alkenyl or alkyl succinic anhydrides in sufficient molar proportion to provide a diimide dispersant having a total mole ratio of about 2.3 to 3.0 moles of anhydride per mole of polyamine.

The polyalkenyl succinic anhydrides useful in the present invention generally comprise those wherein the polyalkenyl group has a $M_n$, number average molecular weight, of about 700 to 5,000, preferably 900 to 2,000. The methods of preparation are well known in the art, i.e., reaction of maleic anhydride with either the polyolefin itself or with a chlorinated polyolefin which in either case provides the desired polyalkenyl succinic anhydride. Polyisobutylene is preferred but other polymers of $C_3$ or $C_4$ olefins such as polybutene-1 and polypropylene are suitable including mixtures of such polyolefins.

Suitable alkylene polyamines are also well known represented by the formula $NH_2(CH_2)_n(NH(CH_2)_n)_mNH_2$ wherein n is 2 to 3 and m is 0 to 10. Illustrative are ethylene diamine, diethylene triamine, triethylene tetramine, tetraethylene pentamine, pentaethylene hexamine, and the like. Preferred for use is tetraethylene pentamine or a mixture of ethylene polyamines which approximates tetraethylene pentamine such as "DOW E-100" (a commercial mixture available from Dow Chemical Company, Midland, Michigan).

The terms polyalkenyl succinimide dispersant or diimide dispersant as used herein are meant to encompass the complete reaction products of the sequential process and are intended to encompass compounds wherein the product may have amide, amidine or salt linkages in addition to the imide linkage which results from the reaction of the primary amino group and the anhydride moeity.

The third reactant used to prepare the dispersants of the present invention encompasses maleic anhydride, succinic anhydride or an alkenyl or alkyl succinic anhydride having up to about 18 carbon atoms and preferably at least 8 carbon atoms. Particularly advantageous results in terms of engine performance data have been obtained with dodecenyl succinic anhydride and maleic anhydride and the use of these materials, and the dispersants produced thereby, represent particularly preferred embodiments.

In the present invention, both the reaction sequence and the overall final mole ratio of total succinic anhydride groups to polyamine in the finished product have been found to be essential to meet the objective of passing both engine qualification tests for gasoline and diesel lubricating oil formulations. The reaction sequence requires a first step in the preparation of a polyisobutenyl succinic anhydride-polyamine reaction product. These are reacted in a mole ratio of about 1.0 to 2.2 moles of polyisobutylene succinic anhydride per mole of polyamine. After this reaction is complete, sufficient maleic anhydride, succinic anhydride or alkenyl succinic anhydride is then reacted to provide a final overall mole ratio in the finished dispersant of between about 2.3 to 3.0 to 1 moles of anhydride of mole of polyamine with the final preferred ratio being 2.3 to 2.5 to 1.

These reactions are carried out at conventional temperatures of about 80° C. to 200° C., more preferably 140° C. to 165° C., using a conventional solvent media, such as a mineral lubricating oil solvent so that the final product is in a convenient solution in lubricating oil which is entirely compatible with a lubricating oil base stock. Suitable solvent oils are the same as the oils used as a lubricating oil base stock and these generally include lubricating oils having a viscosity (ASTM D-445) of about 2 to 40, preferably 5 to 20 centistokes at 99° C., with the primarily paraffinic mineral oils being particularly preferred, such as Solvent Neutral 150.

Lubricating oil compositions are prepared containing the dispersant of the present invention together with conventional amounts of other additives to provide their normal attendant functions such as viscosity index improvers, rust inhibitors, metal detergent additives, antioxidants, and zinc dialkyldithiophosphates antiwear additives and these compositions meet the objective of passing engine qualification tests for both gasoline and diesel engine usage. For gasoline engine lube oils to meet the current "SF" designation of the American Petroleum Institute, lubricating oil formulations must equal or exceed certain values in the MS Sequence VD Engine Test (ASTM Special Publication 315). For dispersancy the significant values in this test are a minimum of 9.4 sludge, 6.7 piston skirt varnish and 6.6 average varnish. The Sequence VD uses a 1980 Ford 2.3 liter 4-cylinder engine and is a 192-hour test comprising the cylcic operation at varying engine speeds and temperatures to simulate "stop and go" city driving and moderate turnpike operation. The test is an established industry standard.

For diesel performance the Caterpillar 1-H/2 test is the current standard to evaluate the effects of a crankcase oil on ring sticking and piston deposits. The test simulates high speed, moderately supercharged engine operation. This test is also Federal Test Method 791-346 and is used to meet military specifications such as MIL-L-21260B and industry specifications such as SAE 183 and General Motors GM6146M. For the 1H-2 TEST WTD (Weighted Total Demerits) is the principal value and for a 240-hour test, the target is a value within or below the 90–100 range. This is derived from the published specification value of WTD 140 for a 480-hour test. WTD is a cumulative rating based on observation of deposits in the groove and land areas of the piston and lacquer on piston skirts with all the specific evaluation being rated according to their relative importance and the final WTD being calculated in accordance with the test procedure.

The dispersants prepared according to the invention can be incorporated in a wide variety of lubricants. They can be used in lubricating oil compositions, such as automotive crankcase lubricating oils, automatic transmission fluids, etc. in effective amounts to provide active ingredient concentrations in finished formulations generally within the range of about 0.5 to 10 weight percent, for example, 1 to 5 weight percent, preferably 1.5 to 3 weight percent, of the total composition. Conventionally, the dispersants are admixed with the lubricating oils as dispersant solution concentrates which usually contain up to about 50 percent weight of the active ingredient additive compound dissolved in mineral oil, preferably a mineral oil having an ASTM D-445 viscosity of about 2 to 40, preferably 5 to 20 centistokes at 99° C. The lubricating oil includes not only hydrocarbon oils of lubricating viscosity derived from petroleum but also includes synthetic lubricating oils such as polyethylene oils; alkyl esters of dicarboxylic acids, complex esters of dicarboxylic acid polyglycol and alcohol; alkyl esters of carbonic or phosphoric acids; polysilicones; flurohydrocarbon oils; and, mixtures or lubricating oils and synthetic oils in any proportion, etc. The term "lubricating oil" for this disclosure includes all the foregoing. The useful dispersant may be conveniently dispersed as a concentrate of 10 to 80 weight percent, preferably up to about 50 weight percent, of said dispersant in 20 to 90 weight percent of mineral oil, e.g., Solvent 150 Neutral oil with or without other additives being present and such concentrates are a further embodiment of this invention.

As noted above, such lubricating oil compositions containing the dispersants of the present invention will also contain other well-known additives such as the zinc dialkyl ($C_3$–$C_8$) dithiophosphate anti-wear agents, generally present in amounts of about 1 to 5 weight percent. Useful detergents include the oil-soluble normal basic or over-based metal, e.g., calcium, magnesium, barium, etc., salts of petroleum naphthenic acids, petroleum sulfonic acids, alkyl benzene sulfuric acids, oil-soluble fatty acids, alkyl salicyclic acids, alkylene bis-phenols and hydrolyzed phosphosulfurized polyolefins. Typical amounts are from 1 to 7 weight percent with the HD or diesel oils usually containing slightly more of this metal detergent additive. Preferred detergents are the calcium and magnesium normal or overbased phenates, sulfurized phenates or sulfonates. Diesel lubricating oils preferably contain 4–6 percent of this additive.

Oxidation inhibitors include hindered phenols, e.g., 2.6-ditertbutyl-para-cresol, amines, sulfurized phenols and alkyl phenothiazines usually present in amounts of from 0.001 to 1 weight percent.

Pour point depressants which may be present in amounts of from 0.01 to 1 weight percent include wax alkylated aromatic hydrocarbons, olefin polymers and copolymers, acrylate and methacrylate polymers and copolymers.

Viscosity index improvers which may vary from about 1 to 15 weight percent depending on the viscosity grade required include olefin polymers such as polybutene, ethylene-propylene copolymers, hydrogenated polymers and copolymers and terpolymers of styrene with isoprene and/or butadiene, polymers of alkyl acrylates or alkyl methacrylates, copolymers of alkyl methacrylates with N-vinyl pyrrolidone or dimethylaminoalkyl methacrylate, post-grafted polymers of ethylene-propylene with an active monomer such as maleic anhydride which may be further reacted with an alcohol or an alkylene polyamine, styrene/maleic anhydride polymers post-treated with alcohols and amines, etc.

Rust inhibition activity can be provided by about 0.01 to 1 weight percent of the afore-mentioned metal dihydrocarbyl dithiophosphates and the corresponding precursor esters phosphosulfurized pinenes, sulfurized olefins and hydrocarbons, sulfurized fatty esters and sulfurized alkyl phenols. Preferred are the zinc dihydrocarbyl dithiophosphates which are salts of dihydrocarbyl esters of dithiophosphoric acids.

Other additives include effective amounts of the fuel economy additives or friction reducing additives such as the dimer acid esters with slurry as disclosed in U.S. Pat. No. 4,105,781 to Shaub which are present (in amounts of about 1 to 5 weight percent) with esters of dimerized linoleic acid and diethylene glycol being a preferred material. Glycerol oleates are another example of fuel economy additives and may be present in very small amounts such as 0.05 to 0.2 weight percent based on the weight of the formulated oil.

This invention is further illustrated by the following examples which are not to be considered as limitative of its scope.

Example 1

1500 grams of PIBSA (polyisobutenyl succinic anhydride Mn=1300, Sap. No. 103) and 170 grams of an ethylene polyamine mixture ("Dow E-100," available from Dow Chemical Company) which approximates tetraethylene pentamine were reacted in solution in 808 grams of Solvent 150 Neutral, a paraffinic mineral oil, at 160° C. for 3 hours. The mole ratio of succinic anhydride to polyamine was 1.4:1. Thereafter was added 225 grams of dodecenyl succinic anhydride which provided a final mole ratio of 2.4 moles of anhydride per mole of polyamine and this was reacted for 2 hours at 160° C. After filtration, the product analyzed at 1.83 percent N.

Example 2

2047 grams of thermal PIBSA having a Sap. No. of 48.5 and a PIB molecular weight of 1300 was mixed with 367 grams of Solvent 150 Neutral, a paraffinic mineral oil, to which mixture was added 137 grams of an ethylene polyamine mixture ("Dow E-100," available from Dow Chemical Company) over a period of 30 minutes at a temperature of 160° C. The resulting reaction mixture was soaked at 160° C. under a $N_2$sparge for three hours. The molar ratio of succinic anhydride to polyamine was 1.3:1. Thereafter to the reaction mixture was added 182 grams of dodecenyl succinic anhydride over a period of one hour and the resulting reaction mixture maintained at 160° C. for two hours under a nitrogen sparge thereby providing a final anhydride:-polyamine mole ratio of 2.3:1. After filtration and the addition of 300 grams of Solvent 150 Neutral oil, the product analyzed for 1.50 percent N.

Example 3

1500 grams of PIBSA (PIB Mn-1300. Sap. No. 103) and 170 grams of an ethylene polyamine mixture ("Dow E-100," available from Dow Chemical Company) were reacted in solution in 808 grams of Solvent 150 Neutral, a paraffinic mineral oil, at 160° C. for three hours under a nitrogen sparge. The mole ratio of succinic anhydride to polyamine was 1.4:1. Thereafter was added 83 grams of maleic anhydride which provided a final mole ratio of 2.4 moles of anhydride per mole of polyamine and this was reacted for two hours at 160° C. under a nitrogen sparge. After filtration and the addition of 300 grams of Solvent 150 Neutral, the product analyzed at 1.71 percent N.

EXAMPLE 4

The product of Example 3 was included as the dispersant at a concentration of 3.6 weight percent active ingredient in a formulated SAE 10W40 lubricating oil composition and subjected to the ASTM Sequence VD engine test for gasoline engines. The formulation also contained conventional amounts of overbased sulfonate, zinc dialkyl dithiophosphate, antioxidant, olefin copolymer viscosity index improver, rust inhibitor and anti-foam additive. The results were as follows:

Sludge=9.51: piston skirt varnish=7.06: varnish=6.92. These results exceed the API "SF" minimum values of 9.4 sludge; 6.7 piston skirt varnish and 6.6 varnish and therefore indicate the material is a commercially useful dispersant.

Example 5

The products of Example 2 and Example 3 were included in a 10W30 quality HD (diesel) lubricating oil formulations as the dispersant at 2.5 weight percent active ingredient concentration and the oil was evaluated for diesel dispersancy performance in the Caterpillar 1-H/2 test. The formulation also contained olefin copolymer V.I. improver to provide the 10W30 viscosity grade, 3.1 weight percent of a mixture of overbased and normal metal phenates, 1.5 weight percent of zinc dialkyl dithiophosphate antiwear additive, and very small proportions of anti-oxidant (0.3 percent) and antifoamant (0.02 percent).

The results for the diesel engine test are given below:

| 240 Hour Caterpillar 1-H/2 Test | | |
|---|---|---|
| Formulation | TGF[2] | WTD[3] |
| Data Base[1] | 16.6 | 189.1 |
| Example 3 | 14 | 66 |
| Example 2 | 11 | 98 |
| Comparison[4] | 1 | 188 |

Example 6

The critical nature of the final ratio of anhydride to polyamine was further demonstrated with additional Caterpillar 1-H/2 tests. In 11 tests using products similar to Examples 3 and 4 but having final mole ratios varying between 1.3 and 2.0, an average WTD value of 163 was obtained. Similarly, for an average of four engine tests where the final mole ratio was 2.1 to 2.2, an average value of 128 WTD was obtained.

What is claimed is:

1. A lubricating oil composition exhibiting improved dispersancy in both gasoline and diesel engines comprising a major amount of lubricating oil and 0.5 to 10 weight percent of a dispersant, said dispersant being prepared in a sequential process comprising the steps of:

(a) in a first step reacting an oil-soluble polyolefin succinic anhydride, the olefin being a $C_3$ or $C_4$ olefin and an alkylene polyamine of the formula $H_2N(CH_2)_n(NH(CH_2)_n)_m\text{-}NH_2$ wherein n is 2 or 3 and m is 0 to 10, in a molar ratio of about 1.0 to 2.2 moles of polyolefin succinic anhydride per mole of polyamine, and (b) reacting the product of step (a) with dicarboxylic acid anhydride selected from the group consisting of maleic anhydride and succinic anhydride in sufficient molar proportions to provide a total mole ratio of about 2,3 to 3.0 moles of anhydride compounds per mole of polyamine.

2. The composition of claim 1 wherein the polyolefin is polyisobutylene of $M_n$900 to 2,000.

3. The composition of claims 1 or 2 wherein the polyamine is an ethylene polyamine.

4. The composition of claims 1 or 2 wherein the dicarboxylic acid anhydride is maleic anhydride.

5. The composition of claims 1 or 2 wherein said total mole ratio is 2.3 to 2.5 to 1.

6. A lubricating oil composition exhibiting improved dispersancy in both gasoline and diesel engines comprising a major amount of lubricating oil and 0.5 to 10 weight percent of a dispersant, conventional amounts of other additives to provide their normal attendant functions, said other additives being selected from the group consisting of viscosity index improvers, rust inhibitors, metal detergent additives, antioxidants and zinc dialkyl dithiophosphate antiwear additives, said dispersant being prepared in a sequential process comprising the steps of:

(a) in a first step reacting an oil-soluble polyolefin succinic anhydride, the olefin being a $C_3$ or $C_4$ olefin, and an alkylene polyamine of the formula $H_2N\text{-}(CH_2)_n\text{—}(NH(CH_2)\text{-}_n)_mNH_2$ wherein n is 2 or 3 and m is 0 to 10, in a molar ratio of about 1.0 to 2.2 moles of polyolefin succinic anhydride per mole of polyamine, and (b) reacting the product of step (a) with a dicarboxylic acid anhydride selected from the group consisting of maleic anhydride and succinic anhydride in sufficient molar proportions to provide a total mole ratio of about 2.3 to 3.0 moles of anhydride compounds per mole of polyamine.

7. The composition of claim 6 wherein there is present about 1 to 15 weight percent of a viscosity index improver.

8. The composition of claim 6 wherein there is present 1 to 7 weight percent of metal detergent additive.

9. The composition of claim 8 wherein the metal detergent additive is present in an amount of about 4 to 6 weight percent and the composition is a diesel lubricating oil composition, the metal detergent additive being a normal or basic metal phenate, sulfurized phenate or sulfonate or mixtures thereof.

10. The composition of claim 6 wherein there is present about 1 to 5 weight percent of a zinc dialkyl dithiophosphate anti-wear additive.

11. The composition of claim 6 wherein there is present 0.001 to 1 weight percent of a rust inhibitor.

12. The composition of claim 6 wherein there is present 0.01 to 1 weight percent of a rust inhibitor.

* * * * *

UNITED STATES PATENT AND TRADEMARK OFFICE

CERTIFICATE OF CORRECTION

PATENT NO. : 4,686,054

DATED : August 11, 1987

INVENTOR(S) : M.J. Wisotsky et al.

It is certified that error appears in the above-identified patent and that said Letters Patent is hereby corrected as shown below:

At Column 7, after Line 20, insert:

[1]Base - These data are an average data base used for comparison in evaluating new diesel oils and are an average of 25 engine tests of conventional formulations.

[2]TGF - Top groove fill, percent deposits in groove.

[3]WTD - Weighted total demerits.

[4]Comparison - The same formulation was tested using as the dispersant a conventional polyisobutenyl succinic anhydride (Mn=900) - ethylene polyamine (DOW E-100) reaction product dispersant where the anhydride to amine mole ratio was 1.3 to 1.

Signed and Sealed this

Twenty-first Day of September, 1993

Bruce Lehman

*Attest:*

BRUCE LEHMAN

*Attesting Officer*

*Commissioner of Patents and Trademarks*